United States Patent [19]

Yang

[11] Patent Number: 5,060,267

[45] Date of Patent: Oct. 22, 1991

[54] METHOD TO PRODUCE AN ANIMAL'S VOICE TO EMBELLISH A MUSIC AND A DEVICE TO PRACTICE THIS METHOD

[76] Inventor: Michael Yang, 4 Fl., No. 28, Lane 42, Tung Kuang Rd., Hsin Chu City, Taiwan

[21] Appl. No.: 409,301

[22] Filed: Sep. 19, 1989

[51] Int. Cl.[5] ..... G10L 5/00

[52] U.S. Cl. ..... 381/36; 381/51

[58] Field of Search ..... 381/36–53

[56] References Cited

U.S. PATENT DOCUMENTS

| | | | |
|---|---|---|---|
| 4,070,550 | 1/1978 | Miller | 370/91 |
| 4,613,985 | 9/1986 | Hashimoto | 381/51 |
| 4,623,970 | 11/1986 | Toyomura | 381/51 |
| 4,624,012 | 11/1986 | Lin et al. | 381/51 |

*Primary Examiner*—Emanuel S. Kemeny
*Attorney, Agent, or Firm*—Bacon & Thomas

[57] ABSTRACT

A method and a device for producing an imitative animal's voice to embellish a music. The animals voice is analyzed and approximated into a waveform represented exclusively by HIGH/LOW, and the time data X of each group of consecutive intervals of the same state are stored in a first ROM. The data X are stored in the consecutive addresses of a first read only memory ROM. When the ROM receives a pulse from a first address counter, the datum X stored in the mth address of the ROM will be sent to a first divider means if the address count of the first address counter is m. To further melodize the imitative animal's voice, the clocks from a first clock generator are compressed or expanded. The data Y, Z of the notes of the desired melody are stored in the consecutive addresses of a second ROM to respectively control the average (or apparent) pitch of the produced imitative voice and the duration of the voice at a given pitch. The device to melodize the imitative voice further comprises a second clock generator, of which the period $t_u''$ is equal to the length of the shortest note of the melody.

8 Claims, 9 Drawing Sheets

ROM

| Address | Amplitude Data |
|---|---|
| 1 | 0 (00 1) |
| 2 | +1 (01 1) |
| 3 | +3 (11 1) |
| 4 | +3 (11 1) |
| 5 | +2 (10 1) |
| 6 | +1 (01 1) |
| 7 | -1 (00 0) |
| 8 | -1 (00 0) |
| 9 | -2 (01 0) |
| 10 | -4 (11 0) |
| 11 | -3 (10 0) |
| 12 | -2 (01 0) |
| 13 | 0 |
| 14 | +2 |
| 15 | +2 |
| 16 | +1 |
| 17 | -1 |

FIG. 3A

PRIOR ART

ROM

| | Address | time Data (X) |
|---|---|---|
| H | 1 | 6 (0101) |
| L | 2 | 6 (0101) |
| H | 3 | 4 (0011) |
| L | 4 | 2 (0001) |
| H | 5 | 2 (0001) |

FIG. 3B

2nd ROM

| Address | Tone data(Y) | Value data(Z) |
|---|---|---|
| 1 | Do ( 1 ) | 3 |
| 2 | Re (≈ 0.89) | 1 |
| 3 | Mi (≈ 0.795) | 3 |
| 4 | Do ( 1 ) | 1 |
| 5 | Mi (≈ 0.795) | 2 |
| 6 | Do ( 1 ) | 2 |
| 7 | Mi (≈ 0.795) | 4 |
| 8 | Re (≈ 0.89) | 3 |
| 9 | Mi (≈ 0.795) | 1 |
| 10 | Fa (≈ 0.75) | 1 |
| 11 | Fa | 1 |
| 12 | Mi | 1 |
| 13 | Re | 1 |
| 14 | Fa | 8 |

METHOD TO PRODUCE AN ANIMAL'S VOICE TO EMBELLISH A MUSIC AND A DEVICE TO PRACTICE THIS METHOD

The present invention relates to a method to produce a voice of an animal as an embellishment or a backing of a music and a device to perform this method.

Animal's voices (for example, a dog's bark or a cat's miaow) are occasionally introduced during the playback or the performance of a music to add to its acoustic effect and fun. Practically, the animal's voices must rhythmically match the music. (See the example in FIG. 7A). A conventional method to produce an imitative voice of an animal, the so-called PCM (pulse code modulation) method, involves the analysis and the digitalization of the animal's voice. The voice is analyzed into a waveform graph on an amplitude-vs.-time coordinate. FIG. 1 shows the characteristic waveform of the realistic voice of an animal (for example, a cat's miaowing). In order to digitalize the amplitude data, the curve in FIG. 1 is stepwise approximated or "truncated" into a curve of step function corresponding to the waveform of the imitative voice. As shown in FIG. 2A., the unit interval for digitalization is $1t_u$, which corresponds to the period of the clocks for the generator of the imitative voice of the animal. The amplitude is divided into eight degrees from $-4$ to $+3$, each corresponding to a 3-bit datum. The HIGH/LOW of the third bit indicates whether the wave is above or below the base line (BL) which makes the abscissa and which corresponds to the zero voltage level of a natural sine wave. The amplitude datum of each interval, in form of a 3-bit code, is sequentially stored in the consecutive addresses of a read only memory (ROM) (See FIG. 3A).

Referring to FIG. 4A, the device for performing the PCM method comprises a clock generator (not shown), an address counter 1 and the aforesaid ROM 2. A clock of frequency $f_s$ (or period $t_u$) generated by the clock generator is applied to the address counter 1. When the address counter 1 receives a clock, it will send a signal via address bus AB to a corresponding address (for example, the first address), to which the address count (for example, 1) of the address counter 1 indicates, so that the amplitude data (001) stored in this address is sent via data bus DB to a digital/analog D/A converter 3 to convert the 3-bit digital code into an amplitude height (0), thus giving the waveform in FIG. 2A. The analog signal is further filtered by a band-pass filter 4, then amplified by an amplifier 5, and finally reproduced by a loudspeaker 6. Now the address count has been shifted by 1 (i.e. from 1 to 2), thus when the address counter 1 receives the next clock, the amplitude data (011) in the 2nd address will be sent out.

The disadvantage of this method consists in its high requirement for the storage capacity of the ROM. In the transient moment of $20t_u$ shown in FIG. 2A, $3\times20=60$ bits are required to store amplitude data. If we require a higher fidelity to the natural voice of the animal, the interval and the amplitude degrees must be more finely subdivided so that the stepwise approximated curve in FIG. 2A can have a better approach to the natural curve in FIG. 1. Such finer subdivision greatly increases the requirement for the capacity of the ROM.

In fact, in the presence of a music, the human audition is not so sensitive to the subtle distinction between a real animal's voice and a distorted reproduction of an imitative voice. In other words, when used to embellish a music, a highly realistic imitative voice produced by an expensive device and a crude imitative voice produced by a cheap one may sound almost the same to the human ears. Therefore, it would be worthwhile to sacrifice a certain realistic subtlety of the animal's voice within the indiscriminable limit of human ears in exchange for a far lower cost.

Accordingly, it is the main object of the present invention to provide an inexpensive method to produce an imitative animal's voice which, in the presence of a music, is not discriminable from a real animal's voice by the human ears.

According to the method of the present invention, the amplitude data in each unit interval $t_u$ is not divided into several different degrees, but divided only into two categories: HIGH and LOW. In other words, the amplitude datum is not encoded into a multi-bit code, but a one-bit code. If the amplitude of a real animal's voice in of a unit interval is below a predetermined level (say, the base line BL), the amplitude data at this interval is taken as LOW. The base line corresponds to the zero voltage of a waveform of a natural sine wave. If the amplitude is at or above this level, the amplitude is taken as HIGH. Each of X consecutive intervals having the same state is taken as a "group" (X is a positive integer). FIG. 2B shows the encoded waveform of the imitative animal's voice according to this invention derived from the real animal's voice in FIG. 1.

From FIG. 2B we can see that the waveform at least indicates the positions of the main peaks and valleys of the curve in FIG. 1, though unable to describe the details thereof. In other words, it indicates that there are two-big mountains from $t=0t_u$ to $6t_u$, and from $t=12t_u$ to $16t_u$, and two big valleys from $t=6t_u$ to $12t_u$, and from $t=16t_u$ to $18t_u$. But is cannot indicate that there are still small peaks and small depressions in the big mountain and valleys. As it is well known, in the formation of a waveform, big mountains and big valleys are formed by low frequency base tones, while small peaks and depressions result from high-frequency overtones. This implies that the imitative voice according to this invention can preserve most of the low-frequency components (base tones), while the high-frequency overtones, which are associated with the subtleties of the voice, are mostly lost.

Since animal's voices are mainly characterized in the low frequency range, and the subtle overtones in the treble range are often drowned out by the music (which is embellished by the animal's sound) and therefore become almost inaudible, such a roughly approximated voice, when reproduced in correspondence to the music, can still offer a satisfactory effect as an embellishment of the music.

[Note: The above-mentioned coding by using one-bit code instead of a plurality of bits to encode the amplitude data is not the characteristic feature of this invention. It is well-known as "cross zero" to the specialist of this field. Also, the aforesaid base line (BL) can be easily determined by the known "cross zero detection". Thus, detailed description of the cross zero is not necessary. The characteristic feature of this invention lies in the novel manner data is stored in the ROM which greatly saves the required positions for storage. According to this invention, it is not the amplitude data of each interval $t_u$, but the time data of consecutive intervals of the same bit value that are stored in the addresses of the ROM.]

Since there are only two kinds of amplitude data: HIGH and LOW, we only need to store the data X of a group comprising X intervals of like HIGH/LOW state in an address of a ROM, without storing the amplitude data (1 or 0) therein. Referring to FIG. 2B and FIG. 3B, during the stage from $t=0$ to $t=6t_u$ (in the first group), the amplitude data are all HIGH, thus the time data $X=6$ is stored in the 1st address of the ROM. In the next stage (In the next group) from $t=6t_u$ to $t=12t_u$, the amplitude data are all LOW. Thus the time data $X=6$ is stored in the second address of the ROM. From FIG. 3B, we see that the amplitude data is HIGH when the address number is an odd number, and is LOW when the address number is an even number. Because of the regular alternation of HIGH and LOW, it is not necessary to store the amplitude data HIGH/-LOW in an address, since an address count itself (odd number or even number) will reveal its corresponding amplitude datum.

In order that the address count in the address counter is only shifted to the next address number after X clocks are given, a divider means is provided. For example, if the address count is 1, the ROM will send the time data $X=6$ to the divider means, which will perform a "divide-by-6" function, so that only a pulse is sent to the address counter to change the address count to 2 when the divider means receives six clocks from the clock generator. Thus the HIGH state may last from $t=0$ till $t=6t_u$. The ROM must be so programmed that when the address count is m, the data X in the mth address is sent to the divider means.

The output signal from the divider means is shown in FIG. 5B. To convert this waveform into the desired waveform of FIG. 2B, we can easily use a flip-flop to convert the signal in FIG. 5B into another (See FIG. 5C) which is exactly the same as the waveform in FIG. 2B. However, even such a flip-flop is not necessary, since an address counter has an available "divide-by-2" circuit which can accomplish the same function as a flip-flop. We only need to supply the signal of FIG. 5B to the "divide-by-2" circuit. The "divide-by-2" circuit will change two adjacent states into one state. In other words, it changes the first HIGH-LOW pair in FIG. 5B (during the stage from $t=0$ to $t=6t_u$) to HIGH, and change the second HIGH-LOW pair in FIG. 5B ($t=6t_u$ to $t=12t_u$) to LOW, and so forth. In so doing, the desired waveform in FIG. 5C can be obtained.

Since the output signal from the address counter (See FIG. 5C) can directly reflect the amplitude of the imitative voice, a D/A converter 3 is no longer necessary.

Therefore, the device according to this invention, apart from the components of the conventional device (except for the D/A converter), further comprises a divider means. Preferably the divider means is a known programmable counter.

Referring to FIG. 3B, suppose the time data X does not (or seldom) exceed 16 in practical use, then we can use a four-bit data to represent the value of X. Thus in the duration of $20t_u$ shown in FIG. 3B, only $4\times5=20$ bits are required to store the time date. This is only one third of the required capacity of the ROM with the data structure in FIG. 3A.

In practical uses, suppose a dog's bark of 0.4 seconds is to be produced in the conventional method, if a conventional PCM 6-bit sampling is adopted, using a sampling frequency of 6 KHz, the required capacity of storage will be $6K\times6\times0.4=14.4K$ bits. In contrast, according to the present invention, only 256 pulses are required in 0.4 seconds. If the divider data X is represented by a 7-bit code, the required capacity is $256\times7=1.8K$ bits. This is only $\frac{1}{8}$ of the required capacity of the conventional method.

In the above method, the apparent pitch of the animal's voice is constant throughout the music. (See FIG. 7A) The non-melodic animal's voice of invariable apparent pitch, when repeatedly generated, may become somewhat monotonous to the listener. Therefore, it is further desired to make the animal "sing". Referring to FIG. 6A, suppose a cat's voice is produced, it is desired that the apparent pitch of the miaowing may vary melodically, so that one can hear the cat "singing" a melody.

[Note: Here we use the term "apparent pitch" instead of "pitch" because an animal's voice is unlike the sound of a musical instrument (e.g., a flute or a violin) which can give a definite pitch. Even a single bar or a miaow of 0.4 seconds may have a higher pitch at its beginning and a lower pitch at its ending. However, such a single bark or miaow still has an "apparent pitch". We can say that the voice of a puppy is higher than that of an old dog because the "apparent pitch" of the former is higher than the "apparent pitch" of the latter.]

In principle, we can easily impart an animal's voice a singing effect by "compressing" or "expanding" the clocks fed to the divider means, so that the rate of the signals entering the ROM also proportionally changes. Since the apparent pitch of the output voice is proportional to the frequency $f_s$ of the clock (or inversely proportional to the period $t_u$ thereof), we can easily raise or lower the tone of the animal's voice by compressing or by expanding the clock to change its frequency (or period). Since the frequency ratio of the tones of a scale, Do:Re:Mi:Fa is 1:1.12:1.258:1.33 (according to "equal temperament") [or 1:9/8:5/4:4/3 according to "just intonation"], we can obtain the desired tones by proportionally varying the average pitch of the animal's voice (and therefore the frequency of the clocks). Suppose the voice produced under the normal frequency $f_s$ of the clock corresponds to the tonic "Do" of a scale, if we "compress" the clock so that the resultant frequency $f_1$ becomes $1.12\ f_s$ (or $9/8f_s$) [or the resultant period $t_u'$ is $0.89t_u$ (or $8/9t_u$)], the produced voice will correspond to the supertonic "Re".

In order to change the frequency of the clock applied to the aforesaid divider means, a second divider means is provided. Thus if the second divider means performs a "divide-by-0.89" function (or multiply-by-9 and then "divide-by-8"), the output voice will correspond to "Re".

In order to offer the melody sung in an animal's voice (like the melody in FIG. 6A) the desired tempo, a second clock generator is provided to produce a clock of frequency $f_2$ (or period $t_u''$).

In order to offer each note of the melody the desired value, a third divider means is provided. Like the first divider means stated before, the second and the third divider means are practically programmable counters, too.

Practically, the shortest note present in the melody ("Sound of Music") of the animal's voice (not to be confused with the embellished musical melody, here "Bach's Minuet" transcribed in 4/4 time) to the clock signal of frequency $f_2$. In other words, the length of the unit note must be equal to the period $t_u''$. For example, in the melody "Sound of Music" shown in FIG. 6A, the shortest note is the quarter note. Thus each clock signal rhythmically corresponds to a quarter note (See FIG. 7B). If the tempo (metronomic number) is "one half note=120", there are 240 quarter notes in one minute. To produce 240 clocks in one minute, the frequency $f_2$ must be $240/60=4H_z$ (or $t_u''=0.25$sec). The value data of a quarter note is represented by 1, the value data of a half note is represented by 2, and so forth.

[Note: The frequency $f_2$ only need to "rhythmically" match the main music, but it is independent from the latter otherwise. For example, a clock of $f_2$ is not necessary to correspond to the shortest note of the music. Referring to FIG. 7B, the main music, which is taken from a Bach's minuet, transformed into two-two time, contains quavers in the second and sixth measures, of which the time value is only 0.125 sec, shorter than a period 0.25 sec of a clock of $f_2$. But this does not matter, since the frequency $f_2$ is not responsible for the main music.]

In order to store the tone data Y ($Y=f_s/f_1=t_u'/t_u$) and value data Z of the notes of the melody, a second ROM is provided. In order to send out the data sequentially, a second address counter for the second ROM is provided.

Thus, according to a further feature of this invention, the device further comprises a pitch-changing means including a second clock generator to produce clocks of frequency $f_2$, a second ROM, a second address counter, and two further divider means.

Referring to FIG. 6B, if the address count of the second address counter is 3, the second ROM will respectively send the tone data (Y=0.795) and the value data (Z=3) to the second and third divider means. The second divider means will perform a "divide-by-0.795" function. Thus the output frequency from the second divider means becomes $f_1=1/0.795=1.25f_s$, which corresponds to the mediant "Mi". Meanwhile the third divider means performs a "divide-by-3" function, so that the address count is only shifted to 4 after the 3rd divider means receives three clocks from the second clock generator. Thus the tone "Mi" lasts for three beats (that means the value of a dotted half note) before it changes to "Do".

Therefore, the melodic output of an animal's voice can be produced by changing the clock of frequency $f_s$ to a clock of frequency $f_1$ for a duration of $Zt_u''$.

This invention will be better understood when read in connection with the accompanying drawing in which:

BRIEF DESCRIPTION OF THE DRAWINGS

FIG. 3A shows the data structure of a ROM for the conventional method in FIG. 2A;

FIG. 3B shows the data structure of a ROM involved in the present invention;

DETAILED DESCRIPTION OF PREFERRED EMBODIMENTS

Figure 1:
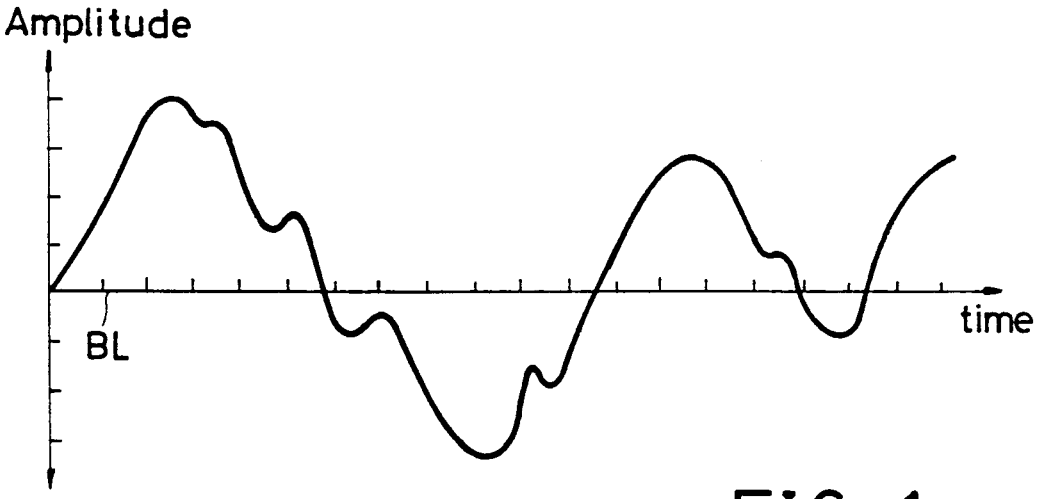
FIG. 1 is a waveform graph of a real animal's voice.
Figure 2A:
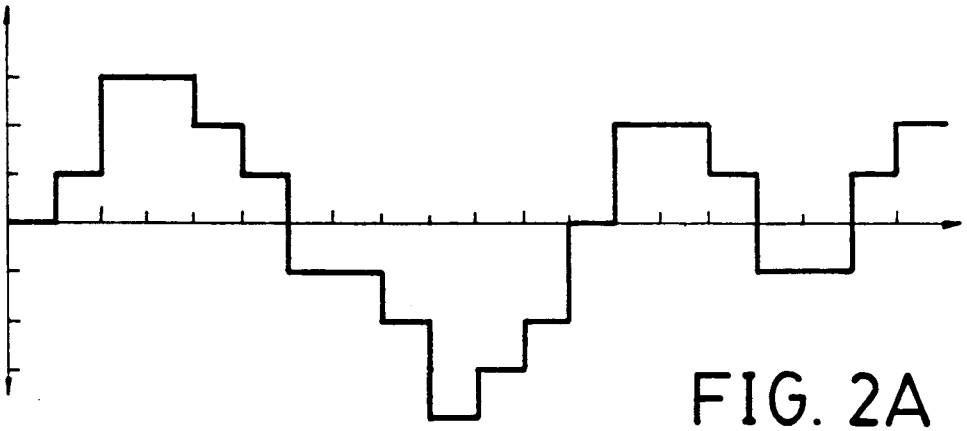
FIG. 2A PRIOR ART
FIG. 2A is a stepwise approximated waveform graph of an artificial animal's voice obtained by the conventional method, imitating the voice of FIG. 1.
Figure 2B:
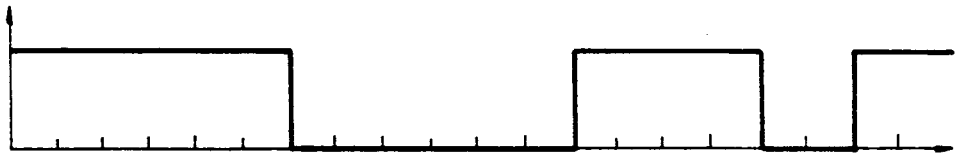
FIG. 2B is a roughly approximated waveform graph of an artificial animal's voice obtained by the method of this invention.
Figure 4A:
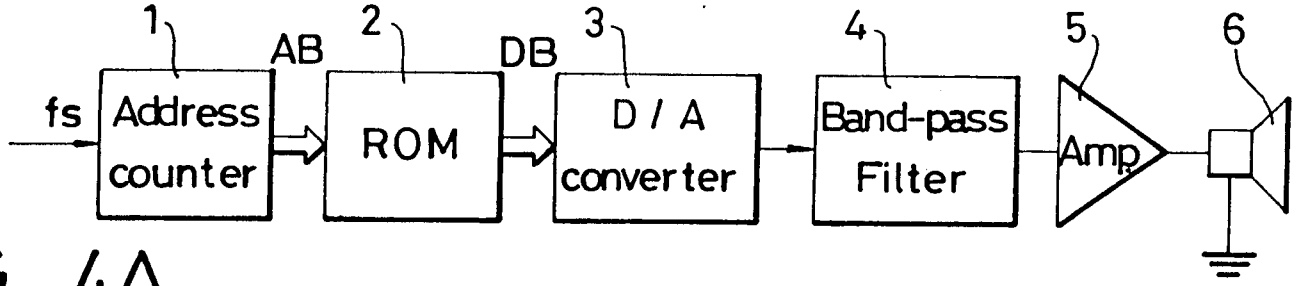
FIG. 4A PRIOR ART
FIG. 4A is a block diagram of the conventional device for producing a non-melodic animal's voice.
Figure 4B:
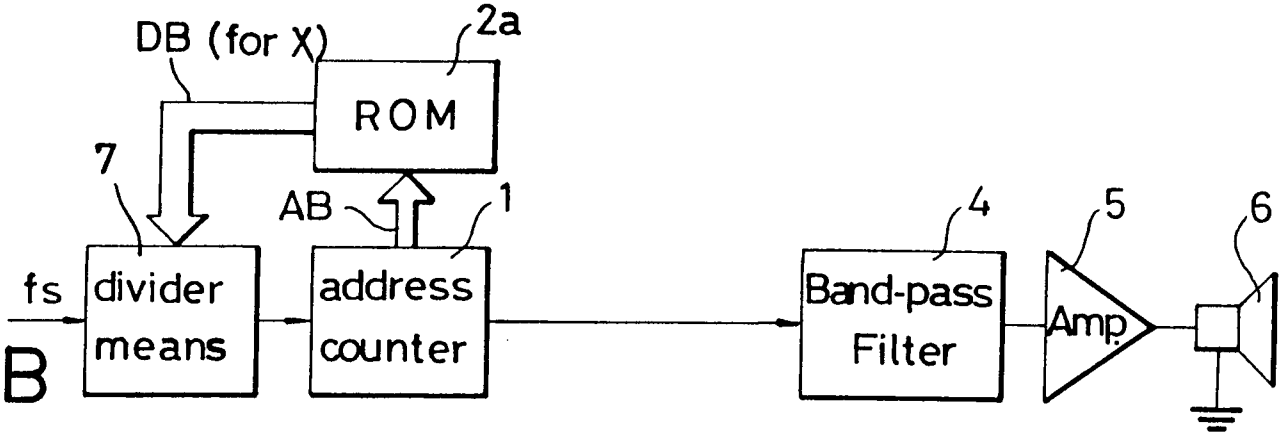
FIG. 4B is a block diagram of a device according to the present invention for producing a non-melodic animal's voice.
Figure 5A:
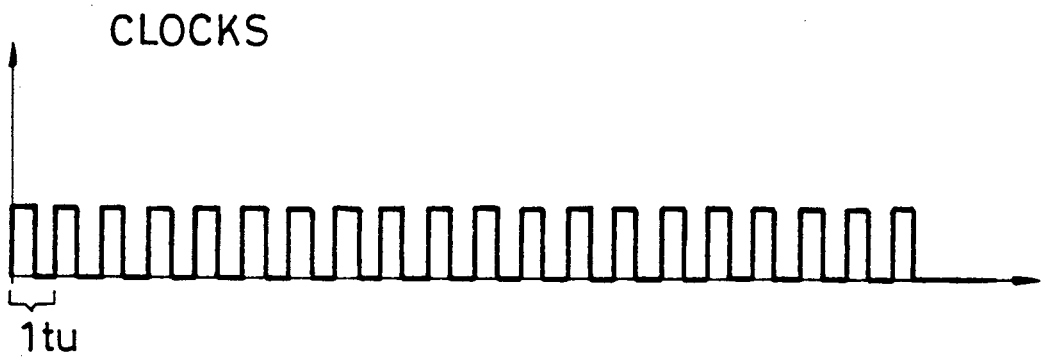
FIGS. 5A to 5C are the waveform graphs respectively showing the clocks $f_s$, the output signals from the divider means, and the output signals from the address counter in FIG. 4B.
Figure 5B:
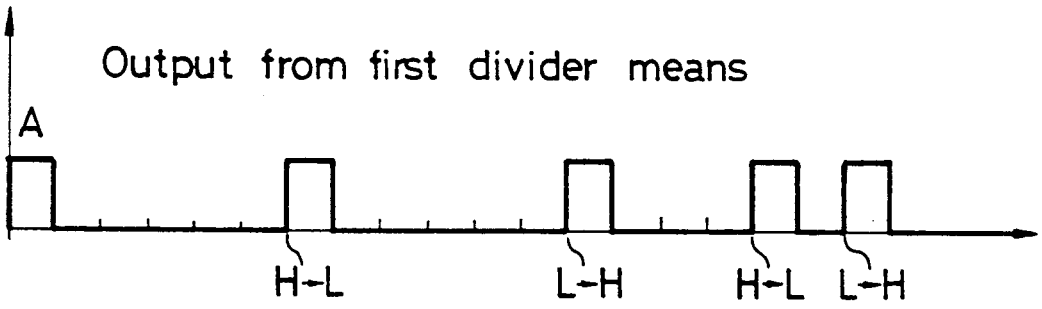
Figure 5C:
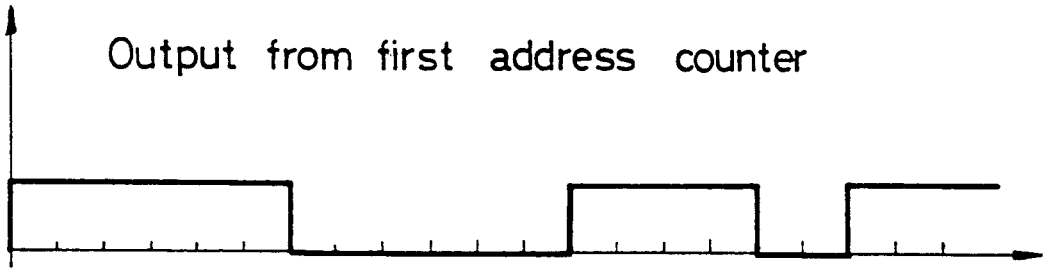

Referring to FIG. 4B, the device of this invention, as stated before, comprises, apart from the elements 4, 5 and 6 similar to the prior art in FIG. 4A, a first address counter 1, a ROM 2*a* and a first divider means 7. Referring to FIG. 3B, if the address count in the address counter 1 is "3", the time data "4" (represented by a four-bit code 0011) is sent via data bus (DB) to the first divider means 7 to perform a "divide-by-4" function, thus the output from the address counter 1 to the band-pass filter 4 maintains HIGH for a duration of $4t_u$. Then the address count becomes 4, and the output is LOW for the next $2t_u$. As the process proceeds, an animal's voice (for example the miaowing of a cat) is produced. The produced miaowing has a constant apparent pitch, and is therefore non-melodic.

Figure 8:
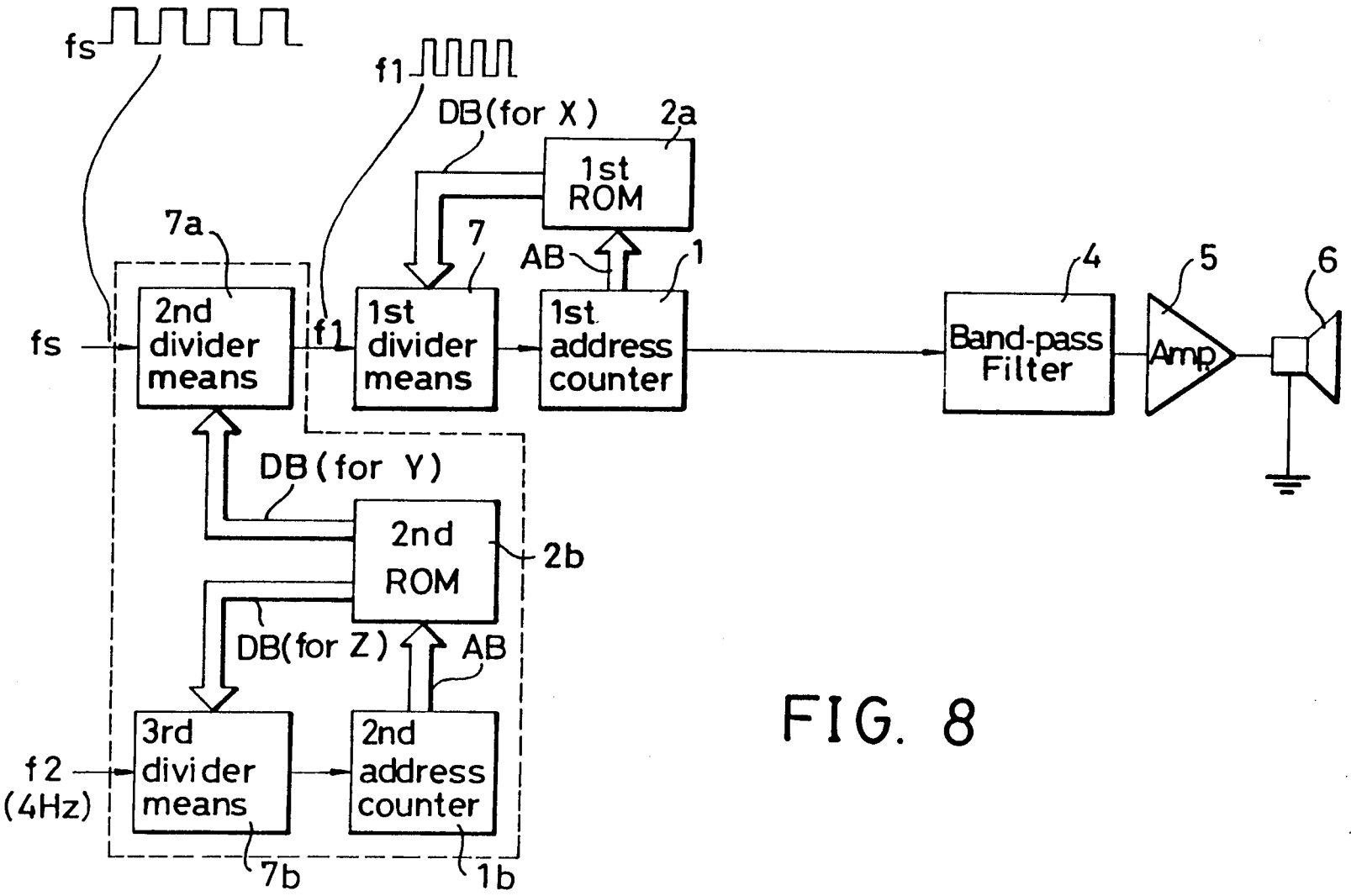
FIG. 8 is a block diagram of a device of this invention for producing a melodic imitation of an animal's voice.
Figure 9A:
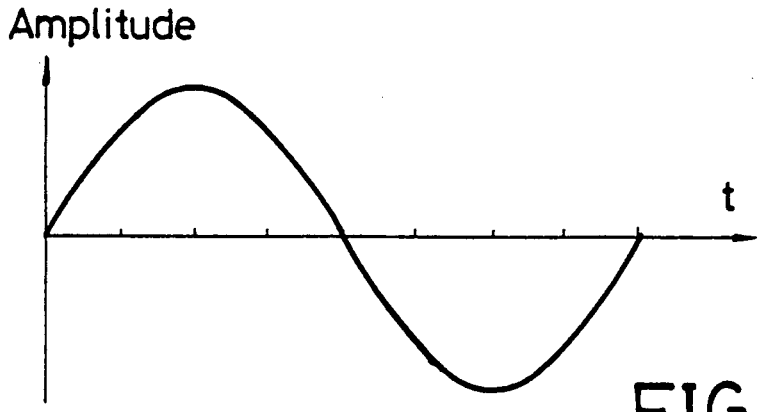
Figure 9B:
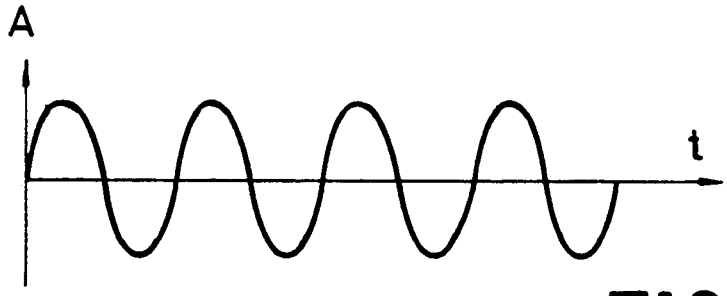
Figure 9C:
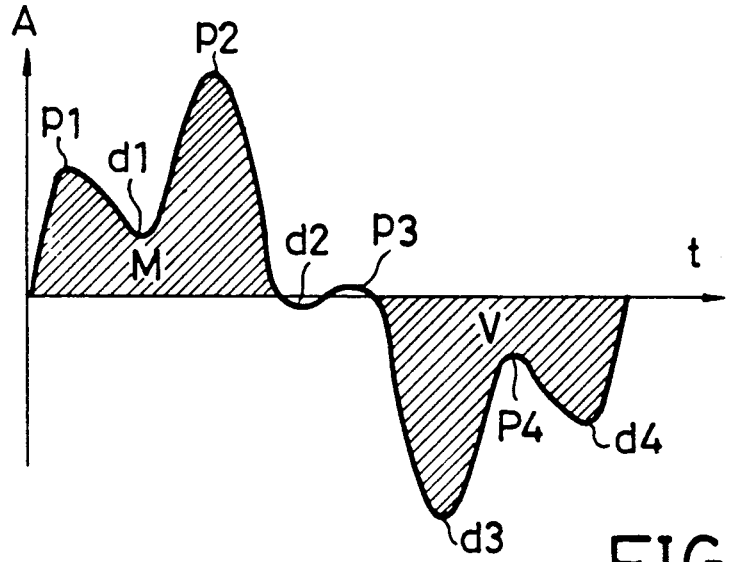
Figure 10A:
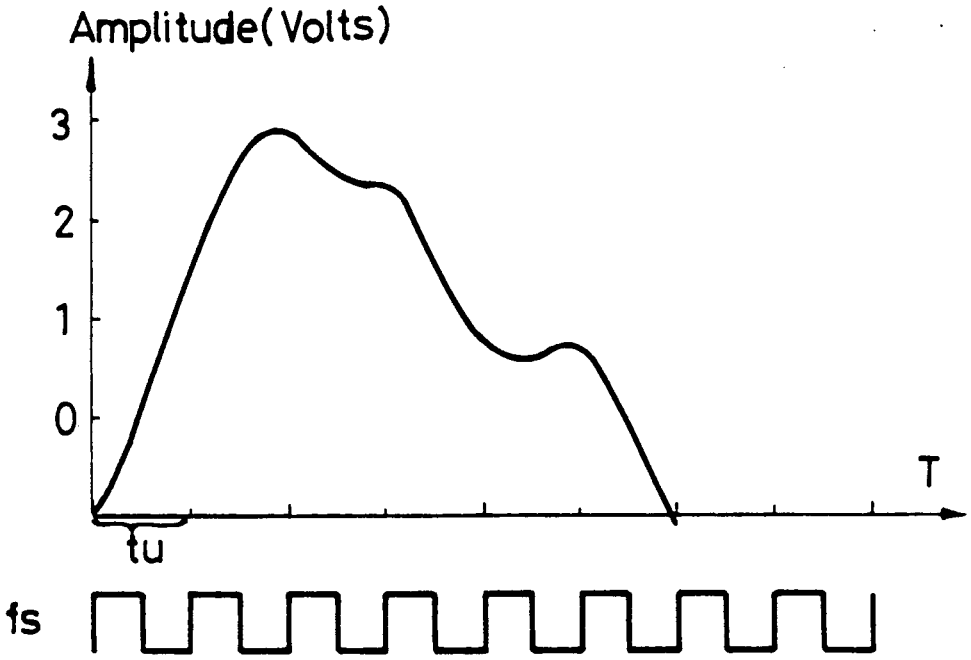
Figure 10B:
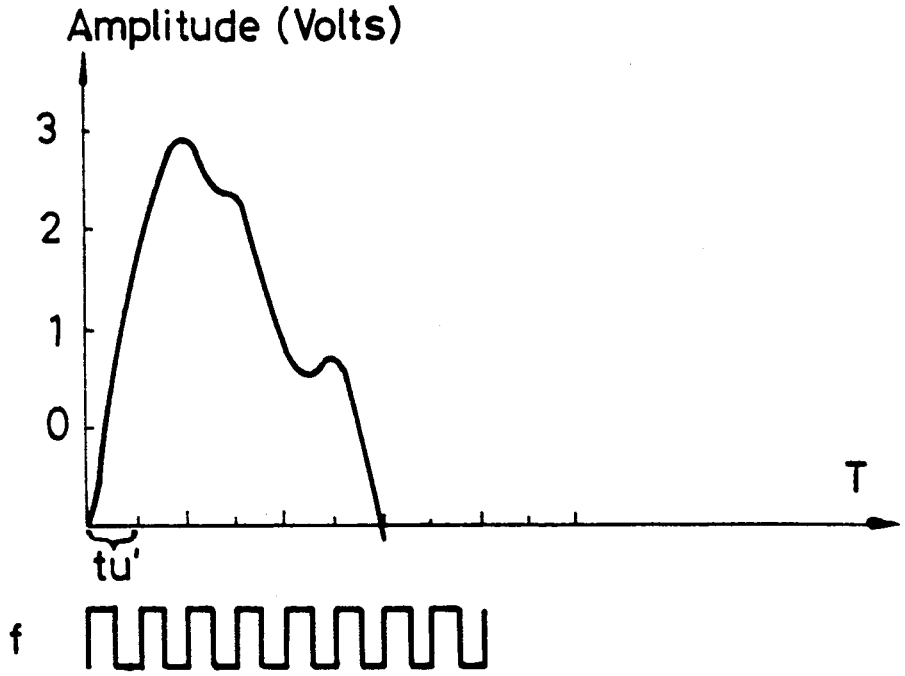

Referring to FIG. 8, to melodize the cat's voice, a second clock generator of frequency $f_2$ (not shown), a second ROM 2*b*, a second address counter 1*b* and two further divider means 7*a* and 7*b* are provided, as stated before. These additional components are included in the area defined in broken lines.

Figures 6A, 6B:
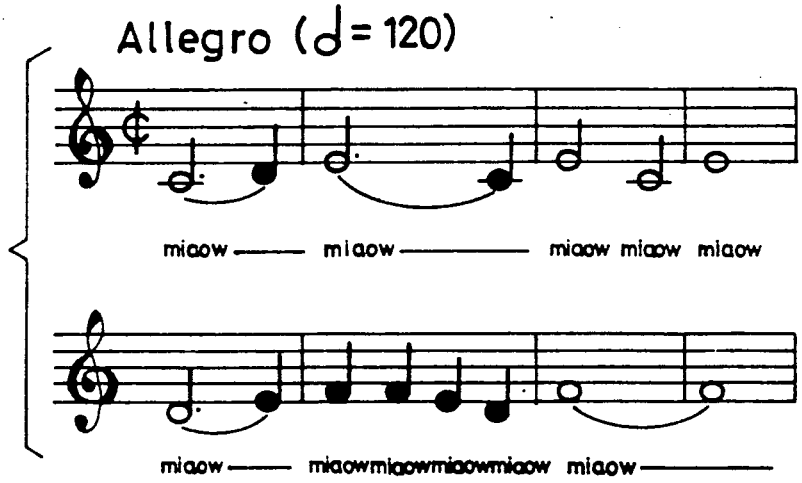
FIG. 6A shows an exemplary melodized animal's voice.
FIG. 6B shows the data structure of a second ROM for storing the relevant data for the rendering of the score in FIG. 6A.
Figure 7A:
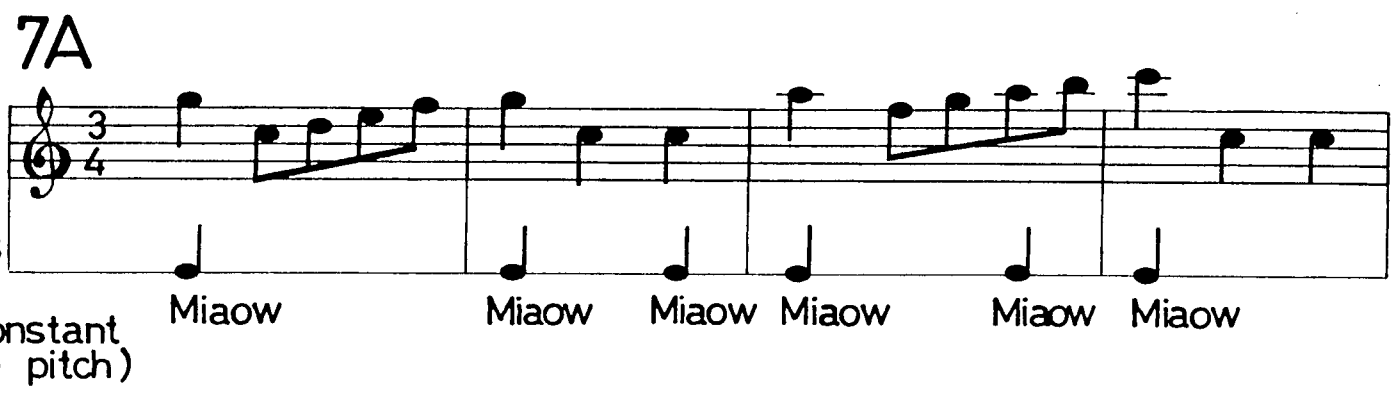
FIG. 7A shows a music rhythmically accompanied by a non-melodic animal's voice.
Figure 7B:
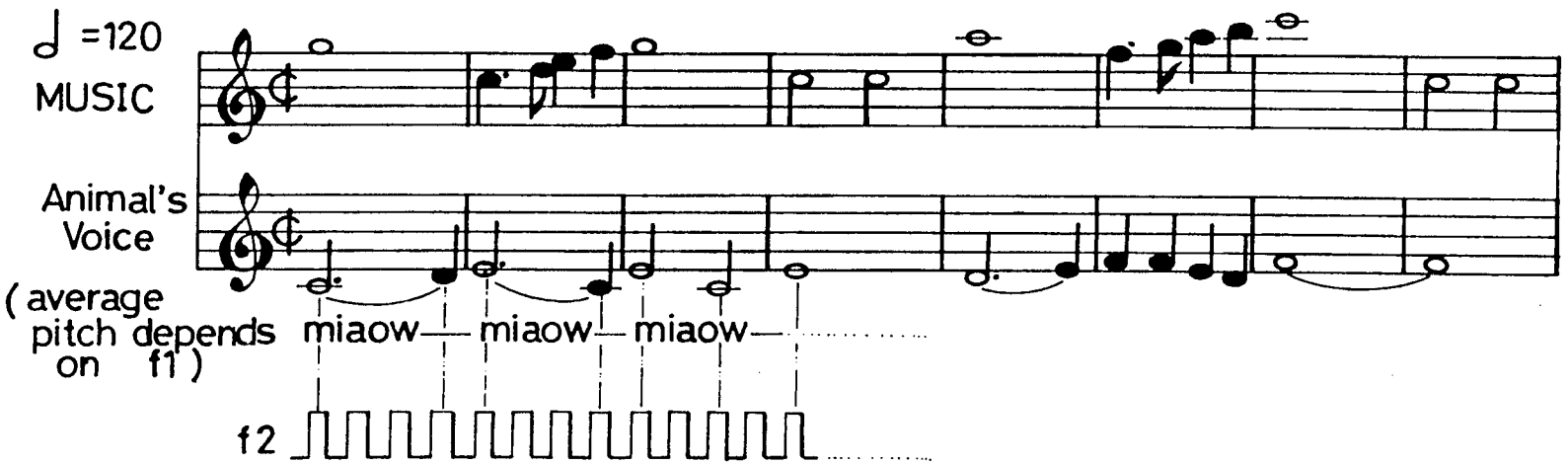
FIG. 7B shows a music rhythmically and harmonically accompanied by the melodized animal's voice shown in FIG. 6A and the corresponding clocks given by the second clock generator.

Referring to FIG. 6B, if the address count in the second address counter 1*b* is "7", the second ROM 2*b* will respectively send the tone data (Y=0.795) [or Y=4/5 according to just intonation] and the value data (Z=4) via corresponding data bus (DB) to the second and the third divider means 7*a* and 7*b*. As a result, the cat's voice will be produced at the vicinity of the pitch of Mi for $4t_u''$, then the address count in the second ROM 2*b* is shifted to "8". The animal's voice thus produced has a melodically changing tone, and is therefore a melodic imitation.

I claim:

1. A method for producing an imitative voice of an animal, comprising the steps of: producing a clock signal of period $t_u$, analyzing the animal's voice in a waveform graph on an amplitude-vs.-time coordinate system; dividing the time-abscissa of said coordinate system into equal intervals, each interval equal to $t_u$; encoding the amplitude of each time interval into corresponding amplitude data; storing the amplitude data in consecutive addresses of a read only memory; and producing the imitative voice by reading the amplitude data sequentially at every interval $t_u$, said amplitude data of each interval being represented by a HIGH signal when the amplitude of the waveform of the said interval is not below a predetermined level and represented by a LOW signal when the amplitude thereof is below the predetermined level, the predetermined level corresponding to the zero voltage level of a natural sine wave, resulting in an approximated waveform represented by the high/low state of the intervals, wherein each series of consecutive intervals of the encoded waveforms with like high/low states is taken as a group, the number of the intervals of each group being chosen as time data values X and stored sequentially in the consecutive addresses of said read only memory, said imitative voice being produced by alternatedly giving a high/low output for a duration $Xt_u$ corresponding to the X values stored in the corresponding address of the ROM.

2. A device for producing an animal's voice, using the method as claimed in claim 1, comprising:

a loudspeaker, an amplifying circuit connected to said loudspeaker, a band-pass filter connected to said amplifier, at least a first clock generator for producing a clock signal having a period $t_u$, a read only memory, an address counter for said read only memory, and a flip-flop, wherein said device further comprises a first divider connected to said read only memory via a data bus, the output of said divider being connected to said flip-flop, and the output of said flip-flop being connected to the output of said band-pass filter, wherein said read only memory is programmed so that when the address count of said address counter is m, the corresponding data X in the mth addresses of said read only memory is sent to said first divider to perform a divide-by-X function.

3. A device as claimed in claim 2, wherein said first divider means is a programmable counter.

4. A device as claimed in claim 2, wherein said flip-flop is a divide-by-2 circuit in said address counter.

5. A device as claimed in claim 2, wherein the output of said clock generator is connected to the input of said divider.

6. A method as claimed in claim 1, further comprising the steps of changing the apparent pitch of said imitative voice to melodize said imitative voice, said step of changing the apparent pitch comprising the changing of period $t_u$ of said clock signal to $t_u'$ in order to change the apparent pitch of said imitative voice to reproduce an imitative voice in the form of a melody; producing a second series of clock signals of period $t_u''$ which corresponds to the length of the shortest note present in said melody, storing a time datum Y and a value datum Z of each note of said melody in the consecutive addresses of a second read only memory, wherein $Y=t_u'/t_u$, Z being a positive integer indicating the value of one said note as a multiple of said shortest note, said imitative voice being melodized by changing the period of said clock signal of period $t_u$ to a clock signal of a corresponding period of $t_u'$ for a duration of $Zt_u''$ corresponding to the data Y and Z stored in the consecutive addresses of said second read only memory.

7. A device as claimed in claim 2, further comprising pitch-changing means for changing the period $t_u$ of the clock signal of said first clock generator to produce said imitative animal's voice in form of a melody, wherein said pitch-changing means comprises:

means including a second clock generator for producing a clock of frequency $f_2$;

a second divider of which the input is connected to the output of said first clock generator and the output is connected to the input of said first divider;

a second read only memory;

a second address counter for said second read only memory;

a third divider of which the input is connected to the output of second clock generator and the output is connected to said second address counter;

wherein each of the addresses of said second read only memory has a tone datum Y and a value datum Z respectively corresponding to the tone and the value of a note of said melody, said second read only memory being programmed so that when the address count of said second address counter is n, and when said second address counter receives a pulse from said third divider, the corresponding tone datum Y and value datum Z in the nth address of said read only memory are respectively sent to said second and said third divider to respectively perform a divide-by-Y and a divide-by-Z function.

8. A device as claimed in claim 7, wherein said second and third dividers are programmable counters.

* * * * *